US006220491B1

(12) United States Patent
Wu

(10) Patent No.: US 6,220,491 B1
(45) Date of Patent: Apr. 24, 2001

(54) AUXILIARY DEVICE FOR A PAINT BARREL

(76) Inventor: Shang-hua Wu, No. 77, Dong-ing 9th Street, Taichung (TW)

( * ) Notice: Subject to any disclaimer, the term of this patent is extended or adjusted under 35 U.S.C. 154(b) by 0 days.

(21) Appl. No.: 09/451,711

(22) Filed: Dec. 1, 1999

(51) Int. Cl.[7] ..... A45F 3/16

(52) U.S. Cl. ..... 224/148.7; 224/257; 224/270; 220/756; 220/764

(58) Field of Search ..... 224/148.7, 257, 224/270; 220/756, 762, 764

(56) References Cited

U.S. PATENT DOCUMENTS

| | | | | |
|---|---|---|---|---|
| 794,948 | * | 7/1905 | Rischard | 224/270 X |
| 2,987,231 | * | 6/1961 | Lewis | 224/148.7 |
| 2,995,281 | * | 8/1961 | Dixon | 224/148.7 |
| 3,876,125 | * | 4/1975 | Emmert | 224/148.7 |
| 4,196,821 | * | 4/1980 | Teti, Jr. et al. | 220/764 X |
| 4,972,982 | * | 11/1990 | Harbour | 224/270 |
| 6,062,389 | * | 5/2000 | Kent | 206/518 |

* cited by examiner

*Primary Examiner*—Stephen K. Cronin
(74) *Attorney, Agent, or Firm*—Rosenberg, Klein & Lee

(57) ABSTRACT

The invention relates to an auxiliary device for a paint barrel which comprises a supporting bar bridged at two opposite sides of a paint barrel body by means of a pivoting attachment structure, a supporting portion to lean on the abdomen of a user provided at the middle part of the supporting bar and a strap attached to the barrel body. In use, the strap hangs on the user's neck and the supporting portion of the supporting bar leans on the abdomen of the user so that said barrel body suspends naturally in front of the user. In this way, the user can easily take the paint from the paint barrel, thereby achieving the purpose of convenience in use.

1 Claim, 4 Drawing Sheets

AUXILIARY DEVICE FOR A PAINT BARREL

FIELD OF THE INVENTION

The invention relates to an auxiliary device for a paint barrel which comprises a supporting bar bridged at two opposite sides of a paint barrel body by means of a pivoting attachment structure, a supporting portion to lean on the abdomen of a user provided at the middle part of the supporting bar and a strap attached to the barrel body. In use, the barrel body suspends naturally in front of the user so that the user can easily take the paint from the paint barrel, thereby achieving the purpose of convenience in use.

BACKGROUND OF THE INVENTION

In general, there are two ways to take paint from the paint barrel. One is that rosin water or water is added into the paint barrel which is bought originally so that the paint is adjusted to a desired concentration by means of the additive. Then, the user carries the paint barrel by one hand and holds a brush to stain and smear the paint by the other hand. The other one is that other container is provided and an appropriate amount of the paint bought is added into the container. Rosin water or water is also added into the container so that the paint is adjusted to a desired concentration. Then, the user carries or holds the container by one hand and holds a brush to stain and smear the paint by the other hand. However, there are the following drawbacks when the paint is smeared by any one of said two ways:

a. It is very inconvenient to carry a paint barrel or a container by one hand and smear the paint by the other hand. A preferred auxiliary device is not generally provided on a paint barrel or a container so that the user has to carry a paint barrel or a container by one hand and smear the paint by the other hand. Because the user must carry a paint barrel or a container with a large weight by one hand and frequently pay attention to toppling of the paint barrel and flowing of the paint out of the barrel, it is very inconvenient for the user to move, thereby resulting in the handicap of elbow.

b. It is very strenuous for the user to carry a paint barrel or a container by one hand. The user has to carry a paint barrel or a container by one hand and the paint barrel or container together with the paint has a large weight so that the user bears a heavier load.

c. It is dangerous for the user to operate by two hands. Because the user has to carry a paint barrel or a container by one hand and smear the paint by the other hand, the user can not place a hand on a ladder or wall when climbing to a high position by a ladder to work, thereby resulting in worry about safety.

The invention provides an auxiliary device for a paint barrel to overcome these drawbacks in the prior art.

SUMMARY OF THE INVENTION

The object of the invention is to provide an auxiliary device for a paint barrel to enhance the flexibility of action, save effort and improve safety. The auxiliary device comprises a supporting bar bridged at two opposite sides of a paint barrel body by means of a pivoting attachment structure, a supporting portion to lean on the abdomen of a user provided at the middle part of the supporting bar and a strap to hang on the user's neck attached to the barrel body. In use, the barrel body suspends naturally in front of a user so that the user can easily take paint from the paint barrel, thereby achieving the purpose of convenience in use.

With the above-mentioned auxiliary device for a paint barrel, the invention has the following advantages:

a. It is very convenient for the user to smear the paint only by a single hand without carrying a paint barrel or a container by the other hand. The supporting bar having a supporting portion and the strap provided on the barrel body make the barrel body suspend naturally in front of the user and the user can work only by a single hand, thereby resulting in convenience and flexibility when the user works.

b. The above-mentioned design of suspension style can save effort. As described, the strap and the supporting bar cooperate with each other to cause the barrel body suspend naturally in front of the user. The way saves effort greatly to decrease the load which the user bears.

c. It is very safe for the user to work only by a single hand. The user works only by a single hand without carrying a paint barrel or a container by the other hand so that the user can place a hand on ladder or wall to enhance safety when climbing to a high position by a ladder to work.

BRIEF DESCRIPTION OF THE DRAWINGS

Other features and advantages of the invention will be evident from the description of particular embodiments, with reference being made to the attached figures, of which.

PREFERRED EMBODIMENTS OF THE INVENTION

Figure 1:
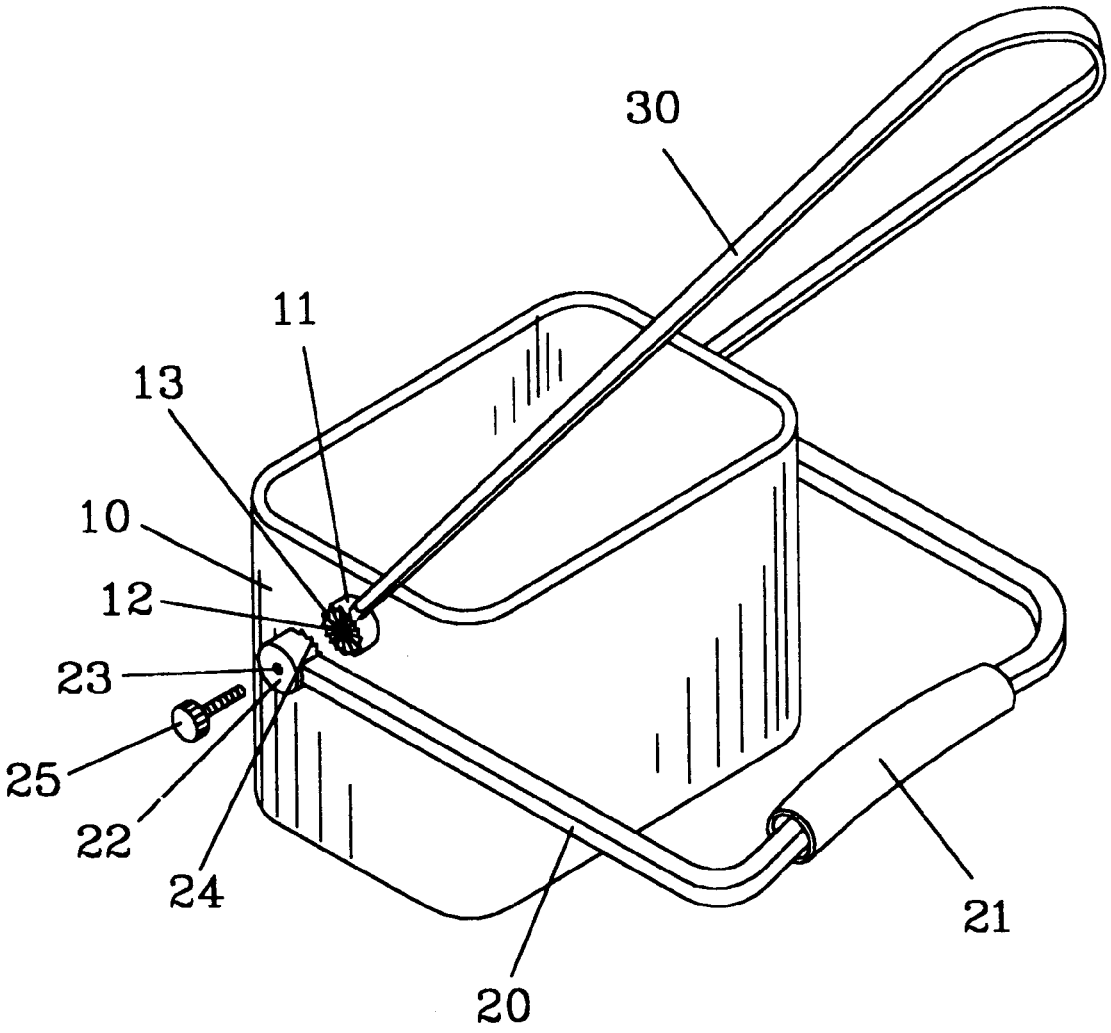
FIG. 1 is an exploded perspective view showing the auxiliary device for a paint barrel according to the invention.
Figure 2:
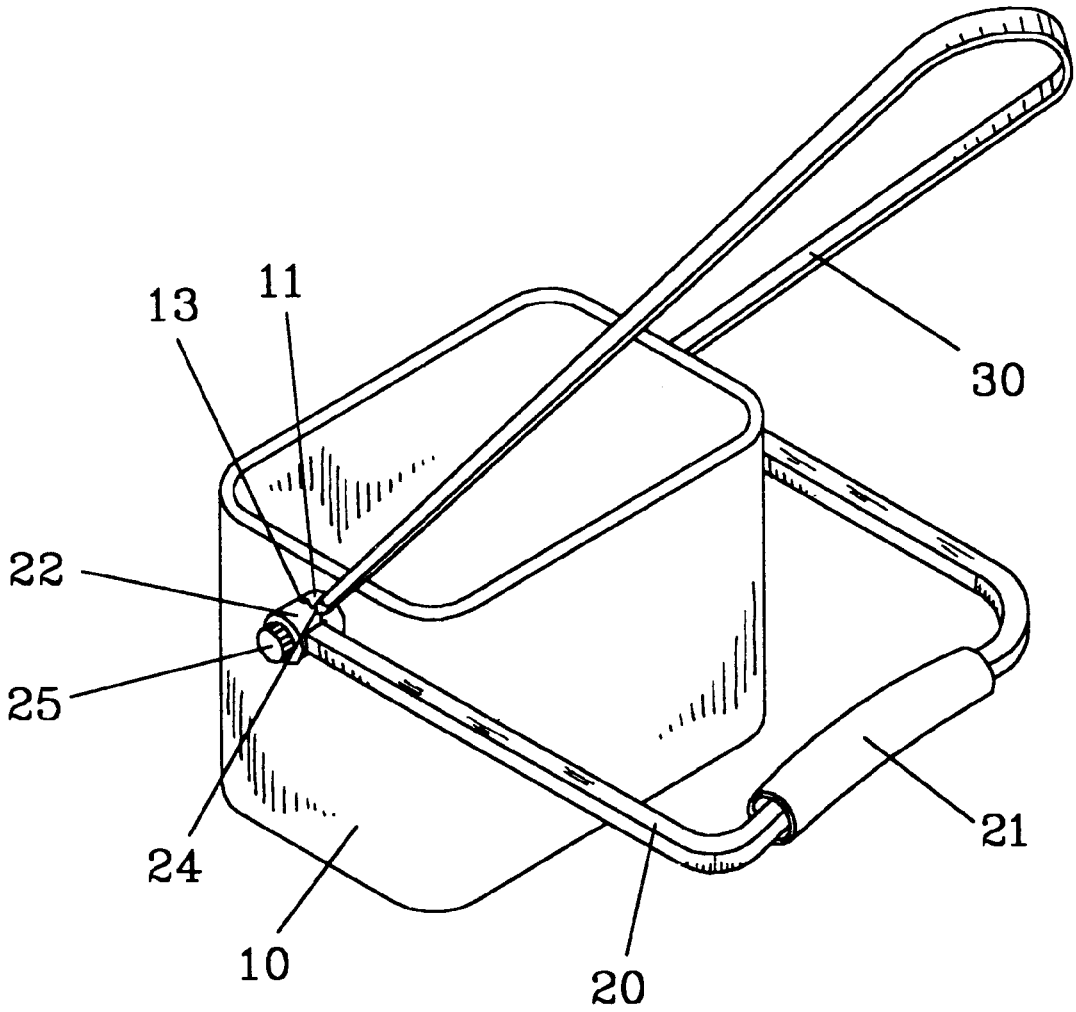
FIG. 2 is a perspective view showing the assembled auxiliary device for a paint barrel according to the invention.

FIGS. 1 and 2 are perspective views showing the auxiliary device for a paint barrel according to the invention. The auxiliary device comprises a supporting bar 20 bridged at two opposite sides of a paint barrel body 10 by means of a pivoting attachment structure. A supporting portion 21 to lean on the abdomen of a user is provided at the middle part of the supporting bar 20 and a strap 30 to hang on the user's neck is attached to the barrel body 10. In use, the strap 30 hangs on the user's neck and the supporting portion 21 of the supporting bar 20 leans on the abdomen of the user so that the barrel body suspends naturally in front of the user. The pivoting attachment structure comprises a lip 11 provided on the outer wall of the barrel body 10. The lip 11 has a bolt hole 12 at the center thereof and a plurality of acanthoid stopper portion 13 disposed radially on its end surface. A block 22 is provided at each end of the supporting bar 20. The block 22 has a through hole 23 at the center thereof and a plurality of acanthoid mating portion 24 on one end surface thereof to engage with said stopper portion 13. A bolt 25 screws into the bolt hole 12 of the lip 11 through the through hole 23 of the block 22 to form a snap-fitting between the mating portion 24 of the block 22 and the stopper portion 13 of the lip 11, thereby the supporting bar 20 attached to the barrel body 10 at a fixed angle relative to the barrel body 10.

Figure 3:
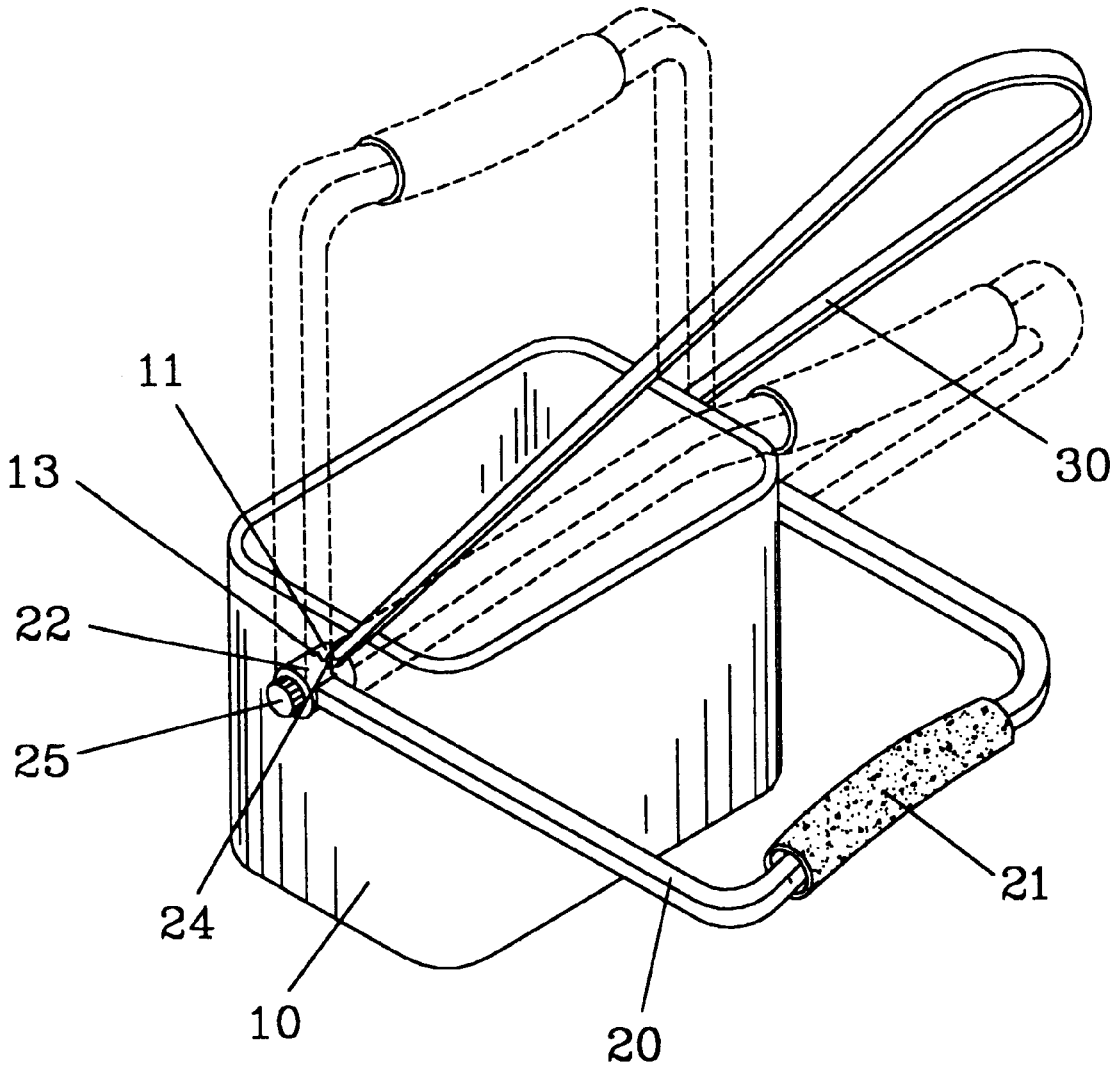
FIG. 3 is a perspective view showing the auxiliary device for a paint barrel according to the invention in different positions.

Referring to FIGS. 2 and 3, when the auxiliary device for a paint barrel according to the invention is assembled with the barrel body 10, the strap 30 is firstly attached to the barrel body 10 and the block 22 of the supporting bar 20 is also placed snugly on the lip 11 of the barrel body 10 with the through hole 23 of the block 22 aligned with the bolt hole 12 of the lip 11. Then, the bolt 25 passes through the through hole 23 of the block 22 from the outer side thereof and screws into the bolt hole 12 of the lip 11, thereby forming the assembled state of the invention.

Figure 4:
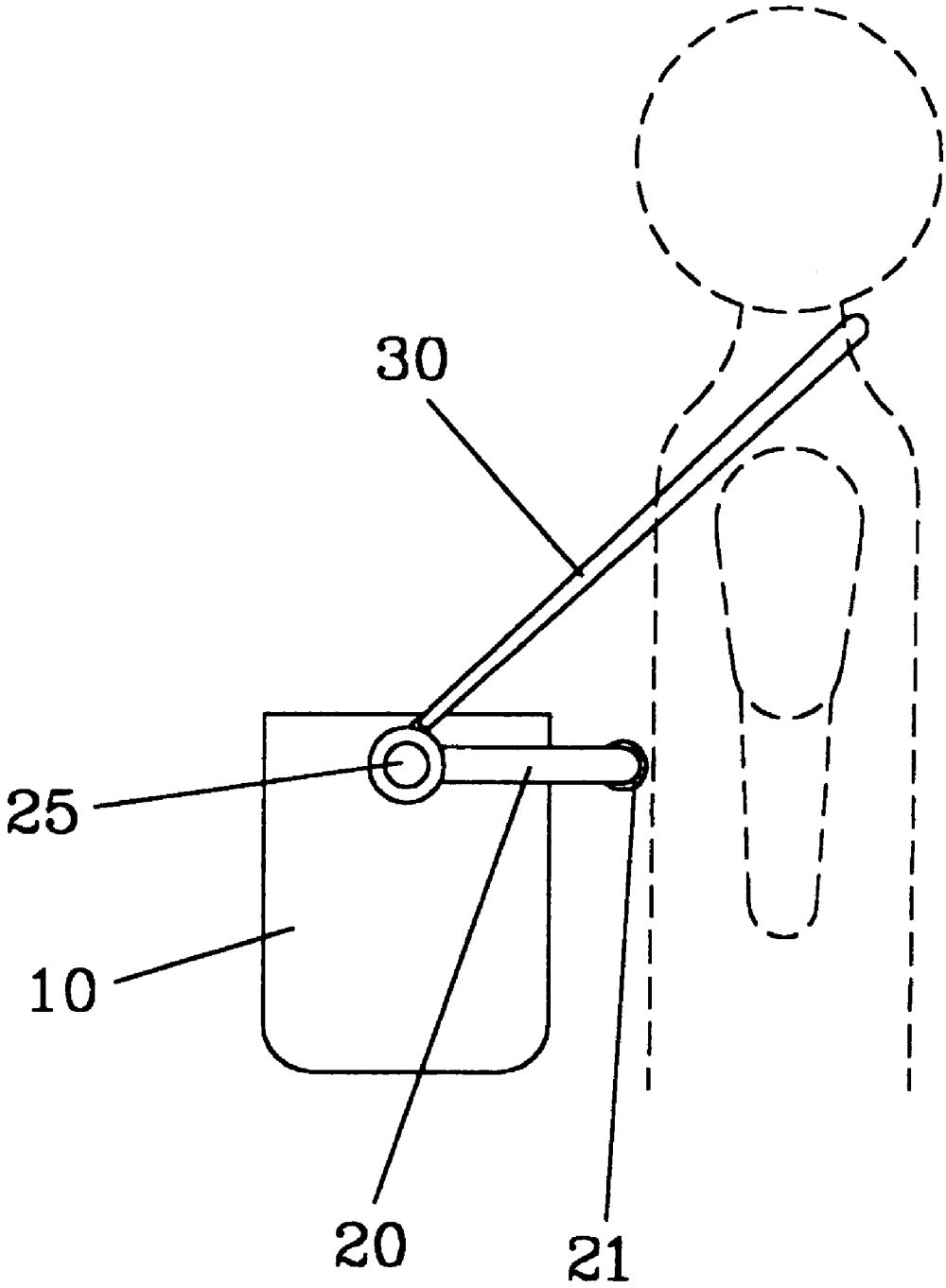
FIG. 4 is a perspective view showing the auxiliary device for a paint barrel according to the invention in use.

Referring to FIGS. 1 and 4, when the auxiliary device for a paint barrel according to the invention is used, the paint adjusted previously to a desired concentration is poured into the inside of the barrel body 10 and the bolt 25 is loosened suitably to rotate the block 22 together with the supporting bar 20 relative to the lip 11. Then, the user may adjust the position of the supporting bar 20 to form a desired angle relative to the barrel body 10 and screws the bolt 25 again to form a snap-fitting between the mating portion 24 of the block 22 and the stopper portion 13 of the lip 11, thereby the supporting bar 20 attached to the barrel body 10 at a fixed angle relative to the barrel body 10. Thereafter, the strap 30 hangs on the user's neck and the supporting portion 21 of the supporting bar 20 leans on the abdomen of the user so that the barrel body suspends naturally in front of the user. In this way, the user can holds a brush to stain the paint from the inside of the barrel body 10 and smear the paint only by a single hand, thereby working in a simple and convenient way.

What is claimed is:

1. An auxiliary device for a paint barrel comprising a supporting bar bridged between two opposite sides of a paint barrel body by a pivoting attachment structure, a supporting portion to lean on a user's abdomen being provided at a middle portion of said supporting bar, and a strap to hang on the user's neck being attached to said barrel body, said strap being hung on the user's neck and said supporting portion of said supporting bar being leaned on the user's abdomen to suspend said barrel body in front of the user, said pivoting attachment structure including a lip provided on an outer wall of said barrel body, said lip having a bolt hole at the center thereof and a plurality of acanthoid stopper portions disposed radially on its end surface, a block provided at each end of said supporting bar, said block having a through hole at a center thereof and a plurality of acanthoid mating portions on one end surface thereof for engaging with said stopper portions, a bolt screwing into said bolt hole of said lip through said through hole of said block to form a snapfitting between said mating portions of said block and said stopper portions of said lip, thereby said supporting bar being attached to said barrel body at a fixed angle relative to said barrel body.

* * * * *